US005885377A

United States Patent [19]

Hsi-Chang

[11] Patent Number: 5,885,377

[45] Date of Patent: Mar. 23, 1999

[54] EQUESTRIAN BIT COMPOSITION

[75] Inventor: Chang Hsi-Chang, Taichung, Taiwan

[73] Assignee: Eastwest International Enterprises, Taichung, Taiwan

[21] Appl. No.: 847,373

[22] Filed: Apr. 24, 1997

[51] Int. Cl.[6] ..... C22C 9/01; B68B 1/06

[52] U.S. Cl. ..... 148/436; 420/489; 54/8

[58] Field of Search ..... 148/436; 420/489; 54/7, 8, 9

[56] References Cited

U.S. PATENT DOCUMENTS 5,669,210 9/1997 Vollmecke et al. ..... 54/8

FOREIGN PATENT DOCUMENTS 499306 11/1976 U.S.S.R. .

*Primary Examiner*—Sikyin Ip
*Attorney, Agent, or Firm*—Antonio R. Durando

[57] ABSTRACT

An equestrian bit is manufactured with a nickel-free alloy containing copper in the range of 85–90 wt %, aluminum in the range of 8–11 wt %, and ferrite in the range of 2–4 wt %. The bit has mechanical strength comparable to prior-art components built with copper alloys containing nickel and is more readily accepted by horses because of its high-copper and nickel-free composition. The preferred composition of the alloy is approximately 88 wt % copper, 10 wt % aluminum, and 2 wt % ferrite.

6 Claims, No Drawings

EQUESTRIAN BIT COMPOSITION

BACKGROUND OF THE INVENTION

1. Field of the Invention

The invention relates to an alloy composition for an equestrian bit.

2. Description of the Prior Art

Conventional equestrian bits include two tubular members coupled to the reins and an elongated member that extends between and is connected to the tubular members. The various bit components are made of metal alloys designed to provide mechanical reliability and ready acceptance by a horse.

Copper has been the metal of choice in the manufacture of horse bits because it is believed to provide a comfortable feeling that renders the bit more tolerable to a horse, which in turn facilitates a rider's ability to control and direct the horse. Because of its relatively high ductility, though, copper alone is not suitable for applications that require high mechanical strength, such as for the stresses and strains typically imposed on horse bit components while riding.

Thus, copper and its oxides have been combined with a variety of other metals to produce stronger alloys capable of withstanding such stresses and strains. From early times to the present, most bit-alloy compositions have been based on copper alloys containing nickel (so called German silver) and zinc, typically in ranges of 50–70 wt % Cu, 12–18 wt % Ni, and 13–25 wt % Zn.

In spite of its usefulness in providing mechanical strength, the utilization of nickel has been disfavored in the trade because the metal is believed to cause dryness in a horse's mouth with some unwanted discomfort that can affect the horse's behavior. Some people have also theorized that nickel may have a toxic effect on the animal. Therefore, much effort has been devoted to improving the alloys used in horse bits by devising nickel-free compositions.

European Patent No. 0 638 655 discloses a nickel-free composition that combines copper with silicon and zinc. The substitution of nickel with silicon (up to 4 wt %) makes it possible to increase the percentage of copper to 81–88 wt %, thereby providing an alloy for bit components that is more pleasant to horses and more easily accepted by them.

Although desirable because free of nickel, I found that the patented composition lacks the tensile strength required for strenuous equestrian applications. Accordingly, the present invention is directed at a novel nickel-free composition with greater mechanical properties than exhibited by prior-art bit components.

SUMMARY OF THE INVENTION

It is an object of the invention to provide a composition for the material used in the manufacture of horse bit components that is free of nickel.

Another object of the invention is to provide a composition for horse bit components having increased mechanical strength with respect to conventional bits.

It is a particular goal of the invention to provide a composition that has greater tensile strength than prior-art nickel-free alloys.

Finally, an objective of the invention is a method of horse-bit manufacture that provides a nickel-free bit with relatively high copper content that is readily accepted by horses and exhibits mechanical properties suitable for strenuous horse-back riding.

The preceding objects, as well as others which will become apparent as the description proceeds, are achieved by a horse bit constructed with a copper alloy containing aluminum and ferrite in a composition with at least 85 wt % copper.

Various other purposes and advantages of the invention will become clear from its description in the specification that follows and from the novel features particularly pointed out in the appended claims. Therefore, to the accomplishment of the objectives described above, this invention consists of the features hereinafter fully described in the detailed description of the preferred embodiment and particularly pointed out in the claims.

DESCRIPTION OF THE PREFERRED EMBODIMENTS

A conventional horse bit comprises two metallic holding or anchoring members which are designed to be fastened to, and to cooperate with, the rings connected to the reins of a horse. The core portion of the horse bit consists of an elongated flexible cable or a swiveled pair of rods that connects the holding members to one another. In use, the cable or the rods are the portions of the bit that remain in the mouth of the horse. Therefore, the composition disclosed herein is directed principally at providing an alloy for the manufacture of those components that are directly in contact with the mouth of the horse, although it can be used for other structural members as well.

I found that a nickel-free copper alloy containing aluminum and ferrite makes it possible to increase the copper content to over 85 wt % and retain the tensile characteristics required for strenuous equestrian use. In particular, compositions containing copper in the range of 85–90 wt %, aluminum in the range of 8–11 wt %, and ferrite in the range of 2–4 wt % have been found to produce bits with mechanical strength and horse acceptance superior to those exhibited by prior-art devices. As used herein, it is understood that ferrite refers to any of several compounds regarded as salts of a ferric hydroxide formed usually by treating hydrated ferric oxide with an alkali or by heating ferric oxide with a metallic oxide, as defined in the metallurgical arts.

The preferred composition for the nickel-free alloy of the invention is approximately 88 wt % copper, 10 wt % aluminum, and 2 wt % ferrite.

Various changes in the details and components that have been described may be made by those skilled in the art within the principles and scope of the invention herein illustrated. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope embraced by any and all equivalent compositions and products.

I claim:

1. A nickel-free alloy for making a horse bit and components thereof comprising:

about 85 to 90 weight percent copper;

about 8 to 11 weight percent aluminum; and about 2 to 4 weight percent ferrite.

2. The nickel-free alloy of claim 1, wherein said copper is about 88 weight percent, said aluminum about 10 weight percent, and said ferrite about 2 weight percent.

3. A horse bit having at least one component manufactured from an alloy comprising:

about 85 to 90 weight percent copper;

about 8 to 11 weight percent aluminum; and about 2 to 4 weight percent ferrite.

4. The horse bit of claim 3, wherein said copper is about 88 weight percent, said aluminum about 10 weight percent, and said ferrite about 2 weight percent.

5. A method of manufacturing a bit for a riding horse, wherein the bit comprises a component intended for placement in the horse's mouth during use, the method comprising the step of forming an alloy made with about 85 to 90 weight percent copper, about 8 to 11 weight percent aluminum, and about 2 to 4 weight percent ferrite into said component.

6. The method of claim 5, wherein said copper is about 88 weight percent, said aluminum about 10 weight percent, and said ferrite about 2 weight percent.

* * * * *

UNITED STATES PATENT AND TRADEMARK OFFICE

CERTIFICATE OF CORRECTION

PATENT NO. : 5,885,377
DATED : March 23,1998
INVENTOR(S) : Chang Hsi-Chang

It is certified that error appears in the above-identified patent and that said Letters Patent is hereby corrected as shown below:

Title page of the patent, Item [73] Assignee, add --(Taiwan)-- after International.

Signed and Sealed this

Thirteenth Day of July, 1999

*Attest:*

*Attesting Officer*

Q. TODD DICKINSON

*Acting Commissioner of Patents and Trademarks*